US007081902B1

(12) United States Patent
Crow et al.

(10) Patent No.: US 7,081,902 B1
(45) Date of Patent: Jul. 25, 2006

(54) APPARATUS, SYSTEM, AND METHOD FOR GAMMA CORRECTION OF SMOOTHED PRIMITIVES

(75) Inventors: Franklin C. Crow, Portola Valley, CA (US); John S. Montrym, Cupertino, CA (US); Matthew J. Craighead, Santa Clara, CA (US)

(73) Assignee: NVIDIA Corporation, Santa Clara, CA (US)

( * ) Notice: Subject to any disclaimer, the term of this patent is extended or adjusted under 35 U.S.C. 154(b) by 0 days.

(21) Appl. No.: 10/671,237

(22) Filed: Sep. 24, 2003

(51) Int. Cl.
*G09G 5/00* (2006.01)

(52) U.S. Cl. ..... 345/611; 345/428; 345/589; 345/593; 345/598; 382/167; 382/261; 382/264; 382/269

(58) Field of Classification Search ..... 345/549, 345/593, 594–599, 601, 639, 640
See application file for complete search history.

(56) References Cited

U.S. PATENT DOCUMENTS

| | | | | |
|---|---|---|---|---|
| 6,522,329 | B1 * | 2/2003 | Ihara et al. | 345/441 |
| 6,606,093 | B1 * | 8/2003 | Gossett et al. | 345/441 |
| 6,671,000 | B1 * | 12/2003 | Cloutier | 348/675 |
| 2002/0158885 | A1 * | 10/2002 | Brokenshire et al. | 345/611 |

OTHER PUBLICATIONS

Crow; "The Use of Grayscale for Improved Raster Display of Vectors and Characters;" *University of Texas*, Austin, Texas; Work supported by the National Science Foundation under Grants MCS 76-83889; pp. 1-5.
Boyer, et al.; "Discrete Analysis for Antialiased Lines;" *Eurographics* 2000; 3 Pages.

* cited by examiner

*Primary Examiner*—Kee M. Tung
*Assistant Examiner*—Antonio Caschera
(74) *Attorney, Agent, or Firm*—Cooley Godward LLP

(57) ABSTRACT

A graphics processor performed gamma correction of the coverage values of pixels. In one embodiment, a gamma correction factor is written into a run-time loadable lookup table of the graphics processor. The gamma corrected coverage values may be used in an anti-aliasing process to form smoothed primitives.

20 Claims, 8 Drawing Sheets

APPARATUS, SYSTEM, AND METHOD FOR GAMMA CORRECTION OF SMOOTHED PRIMITIVES

FIELD OF THE INVENTION

The present invention is generally related to techniques for gamma correction of graphical images. More particularly, the present invention is directed towards using a graphics processor for gamma correction of smoothed primitives independently of gamma correction of the whole image.

BACKGROUND OF THE INVENTION

Displays, such as cathode ray tubes (CRTs), typically have a non-linear response in which the brightness of the display is proportional to an input voltage signal raised to the gamma power, i.e., by a factor proportional to $v^{\gamma}$, where $\gamma$ is the gamma coefficient, and v is the input voltage. The non-linear response of the display, if uncorrected, would result in the displayed brightness for the pixels being different from that which was intended. Consequently, it is desirable to perform a gamma correction of the input to the display to compensate for the non-linearity of the display.

FIG. 1 illustrates a conventional graphics system that includes gamma correction of each pixel output to a display screen. Referring to FIG. 1, a conventional graphics system 100 may include a central processing unit (CPU) 110, system memory 120, graphics processor 130, frame buffer 140, digital to analog converter (DAC) 150, and display 160. A suitable communications bus for communicating data and instructions between CPU 110 and graphics processor 130 may include a bridge 115. (DAC) 150 is used to convert the digital output signal of a frame buffer into an analog signal suitable for a CRT. Gamma correction factors may be stored in a lookup table 155 of the DAC.

One drawback of conventional gamma correction is that the edges of smoothed primitives (e.g., anti-aliased lines, anti-aliased stippled lines, anti-aliased points, and anti-aliased polygons) may appear uneven unless the gamma correction for the whole display is adjusted to optimize the appearance of the edges. However, applying gamma correction to the whole display sufficient to optimize the appearance of the edges of smoothed primitives may result in a gamma correction factor for the entire screen that results in other portions of an image looking washed out.

In common graphics usage, smoothed primitives are primitives whose outer edges have been blended with adjacent colors for a smoother appearance. Jaggies are artifacts of aliasing in which curved lines and diagonal lines appear to have jagged edges due to the discrete pixel locations of the display. Roping is an aliasing effect in which a line appears to change in at least one attribute (e.g., color, brightness, or width) to produce a pattern suggestive of a braided rope.

In an anti-aliasing process, an account must be made of how the primitive overlaps individual pixels of a pixel grid. Changes in the location or orientation of a primitive affects the pixel coverage. For example, if the edge of a primitive moves by a half-pixel, then a fully-covered pixel may become a half-covered pixel and its color would have to change from the color of the primitive to a 50-50 blend of the primitive color and the adjacent background color. Similarly, a nearly vertical edge may fully cover one pixel but cover only 9/10 of the pixel below and only 8/10 of the pixel below that, and so forth until it covers none of the pixel 10 lines below. The change in color must reflect the linear progression of pixel coverage. If the display is non-linear then the edge will appear scalloped as it spans hundreds of pixels. As such an edge changes its orientation, the spacing of the scalloping will change accordingly. (A primitive nearly aligned to the pixel grid will have different jaggies than a similar shaped primitive oriented at a larger angle with respect to the pixel grid). As a result, even smoothed primitives may have brightness non-uniformities across their edges that depend upon the angular orientation of the edges and the non-linearity of the display. These brightness non-uniformities are exacerbated by the gamma of the display and can cause noticeable roping effects, particularly for smoothed primitives that move across a display such that their edges change their angular orientation.

Roping effects in smoothed primitives are annoying in a variety of applications. However, these roping effects are of particular concern in applications in which narrow lines may have an arbitrary angle and/or move across a display surface. For example, a graphics system that has an adequate gamma correction of static textual windows and icons may have noticeable roping effects for graphics applications displaying lines and edges at arbitrary angles. Additionally, in some graphics systems a gamma correction suitable for viewing static windows icons produces unacceptable artifacts when viewing lines.

Therefore, what is desired is an improved apparatus, system, and method for gamma correction of smoothed primitives.

SUMMARY OF THE INVENTION

A graphics processor performs gamma correction of pixel coverage values. In one embodiment, the graphics processor includes a run time loadable antialiasing lookup table that has a gamma correction factor written into the lookup table. In some embodiments, a graphical user interface is generated having a control panel for a user to input a request for the graphics processor to perform gamma correction.

One embodiment of a method of reducing visual artifacts includes storing a gamma correction factor in a lookup table of a graphics processor, generating rasterized pixels of a graphical image, determining a coverage value for each fragment of a primitive of the graphical image, reading the lookup table for the gamma correction factor, and gamma correcting the coverage value of each partially covered pixel to form gamma corrected coverage values.

One embodiment of a graphics processor includes a coverage completion module to calculate a coverage value per pixel of a primitive and a lookup table to store a gamma correction factor for partially covered pixels. In this embodiment, the graphics processor reads the gamma correction factor to form a gamma corrected coverage value for each partially covered pixel.

BRIEF DESCRIPTION OF THE FIGURES

The invention is more fully appreciated in connection with the following detailed description taken in conjunction with the accompanying drawings, in which.

Like reference numerals refer to corresponding parts throughout the several views of the drawings.

DETAILED DESCRIPTION OF THE INVENTION

Figure 1:
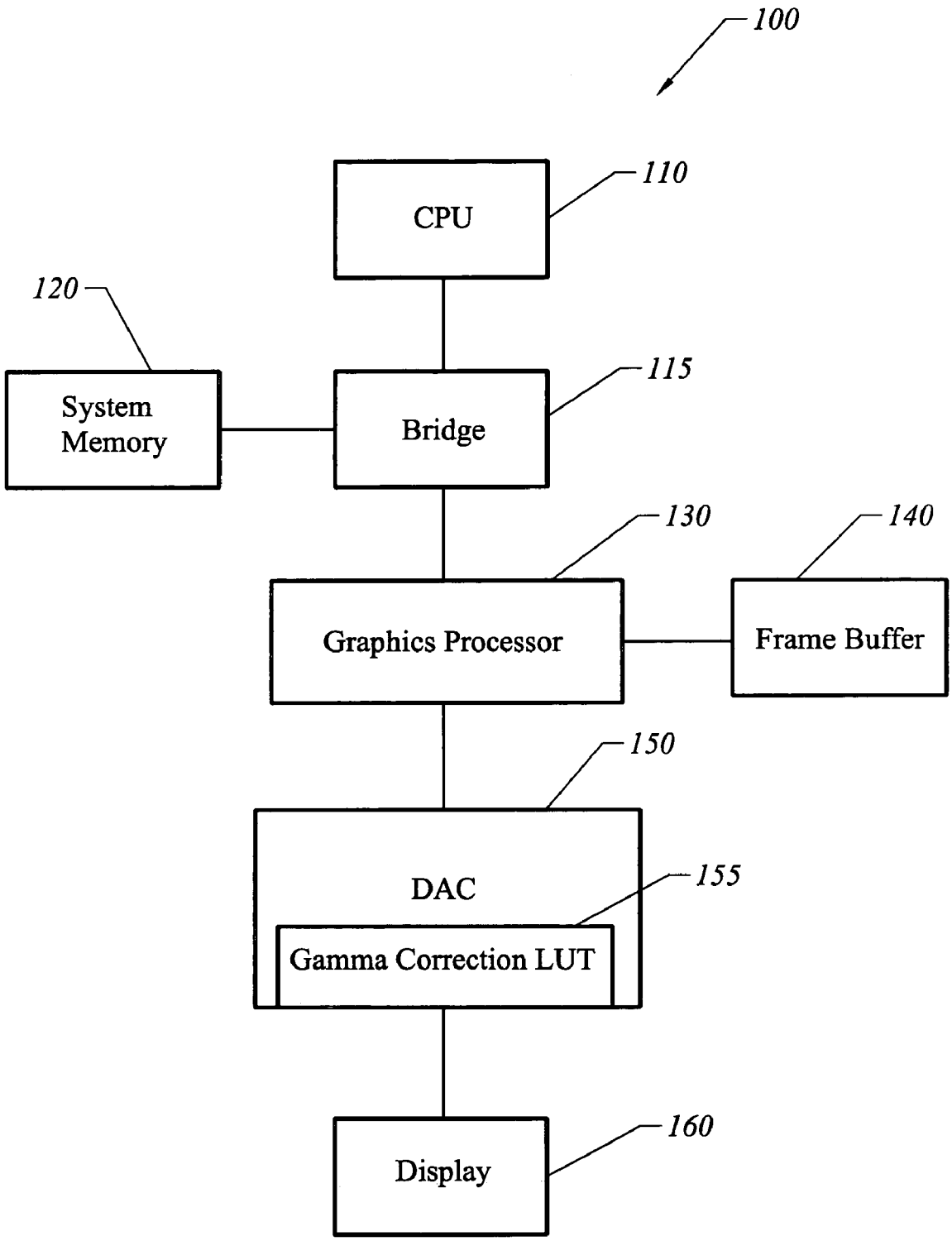
FIG. 1 (Prior Art)
FIG. 1 is a block diagram of a prior art graphics system with gamma correction of an entire display screen.
Figure 2:
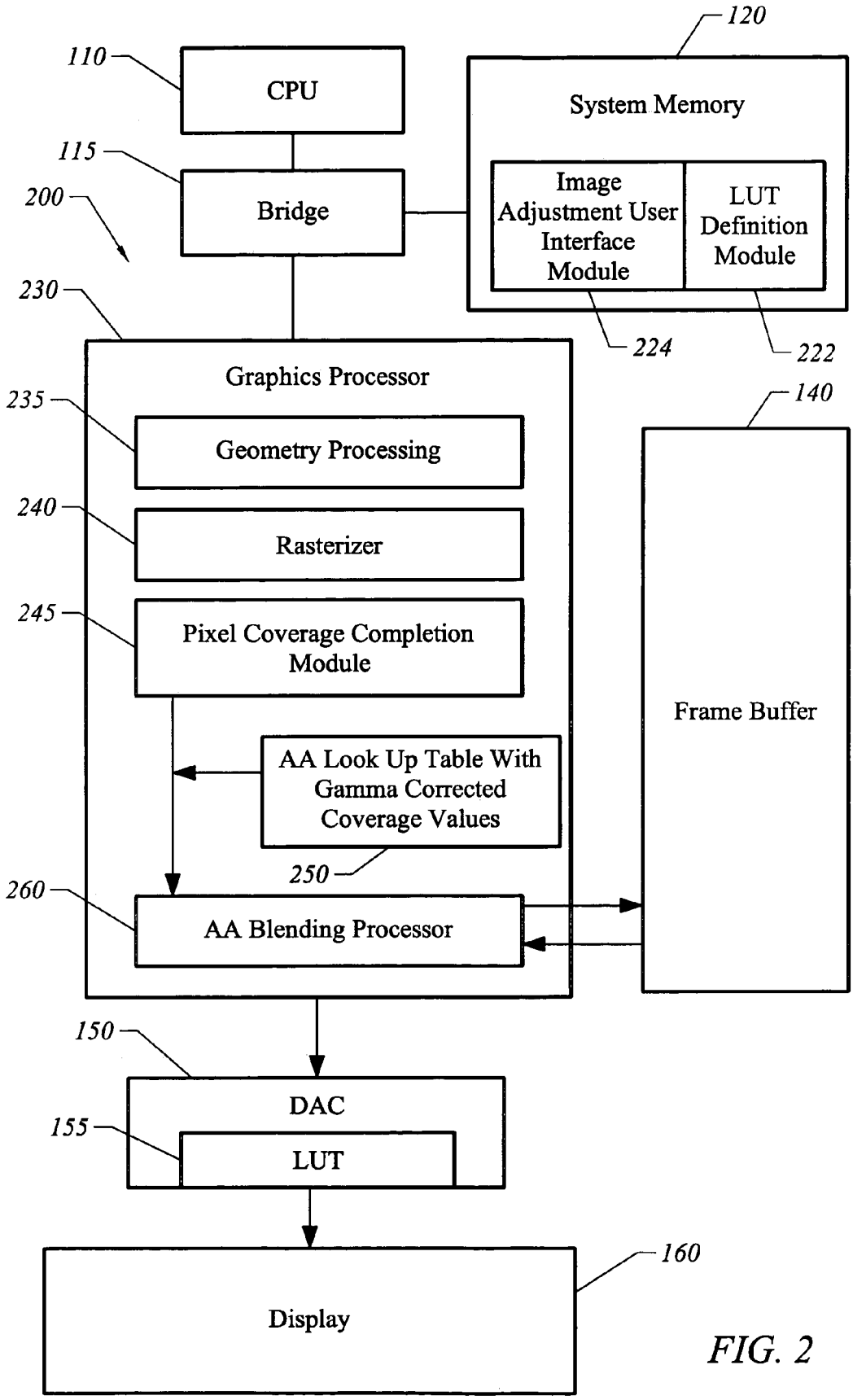
FIG. 2 is a block diagram of a graphics system with gamma correction of smoothed primitives in accordance with one embodiment of the present invention.

FIG. 2 is a block diagram of one embodiment of a graphics system 200 of the present invention for gamma correction of pixel coverage values used to antialias smoothed primitives. The CPU 110, bridge 115, frame buffer 140, DAC 150, and display 160 components are conventional and the same as described in regards to FIG. 1.

In the present invention, the hardware of graphics processor 230 is adapted to permit a gamma correction factor to be written to the graphics processor for use in gamma correcting pixel coverage values. Graphics processor 230 includes a graphics pipeline for geometry processing (e.g., transform and lighting), pixel processing (e.g., pixel shading and texture mapping) and raster operations. Some conventional components of graphics processor 230 are omitted for clarity.

In one embodiment, graphics processor 230 includes a geometry processor 235 to generate primitives and a rasterizer 240 to rasterize primitives, i.e., to convert points, lines, and polygons to fragments, each fragment corresponding to a single pixel of a framebuffer. A pixel coverage completion module 245 determines the coverage value of fragments of the primitive with respect to a pixel grid. Pixel coverage completion module 245 may, for example, use a sampling technique to sample points within each pixel, determine a coverage value based on the angle of the primitive with respect to the pixel grid, or use any other algorithm known in the art to calculate a coverage value by estimating the overlap of a fragment with an individual pixel.

Some aspects of pixel coverage issues addressed by the present invention may be understood with regards to FIGS. 3–6, which show rasterized primitives superimposed on a pixel grid to illustrate partially covered pixels. As can be seen in FIGS. 3–6, the coverage values along an edge may vary considerably, except for the special case in FIG. 3 that the edge is symmetrically aligned with the pixel grid.

Figure 3:
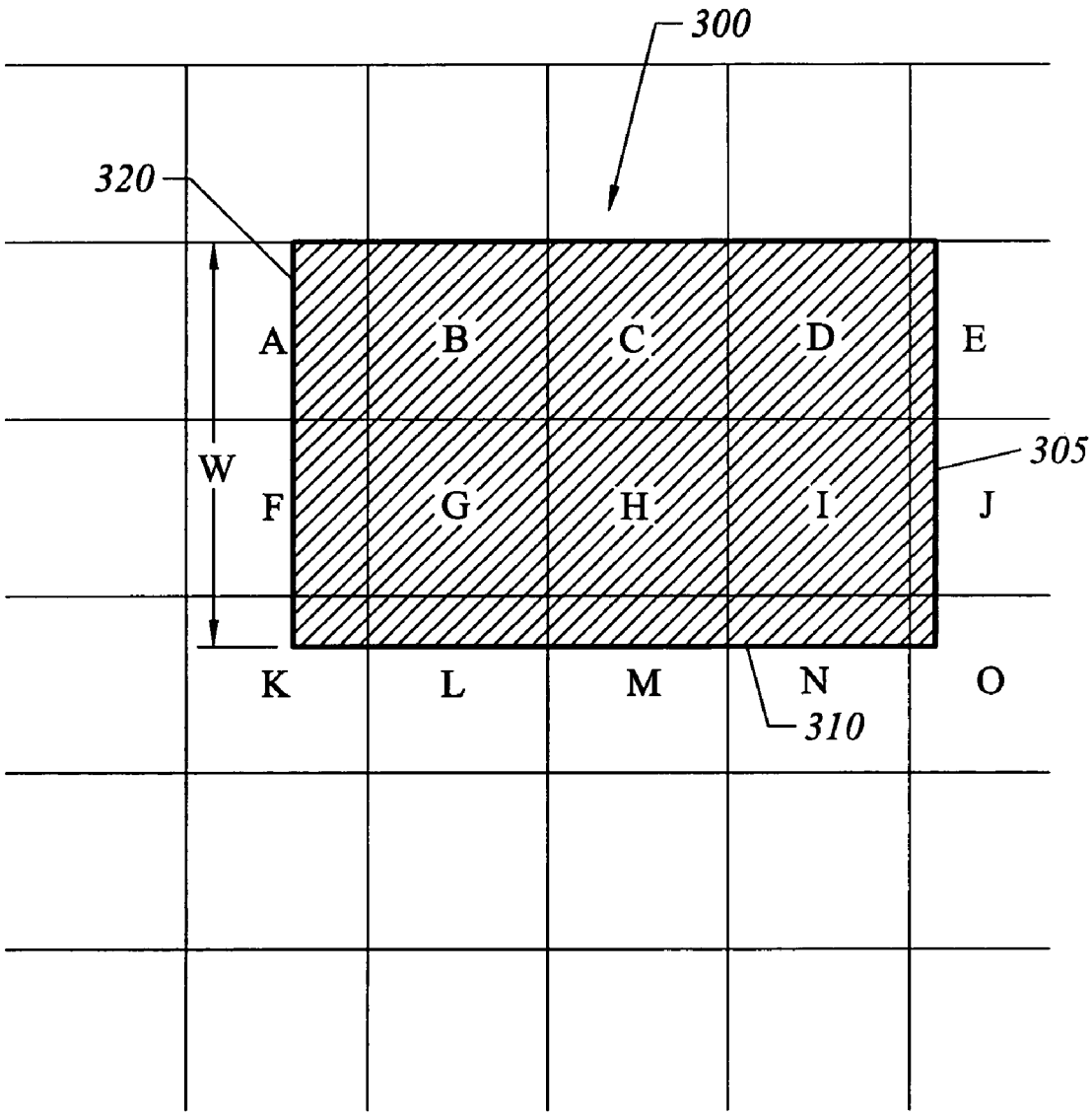
FIG. 3 is a diagram illustrating pixel coverage of a rectangle within a pixel grid.

Referring to FIG. 3, a rasterized line segment 300 is shown overlapping a pixel grid. The brightness of the line segment may be represented by its width, W. For this example, pixels B, C, D, G, H, and I are completely covered. Pixels A, F, K, L, M, M, O, J, and E are partially covered pixels. However, note that in the example of FIG. 3 that the primitive is aligned to the pixel grid and consequently, the coverage values of many of the adjacent pixels along each edge are identical, such as pixels A and F on edge 320, pixels L, M, and N on edge 310, and pixels E and J on edge 305.

Figure 4:
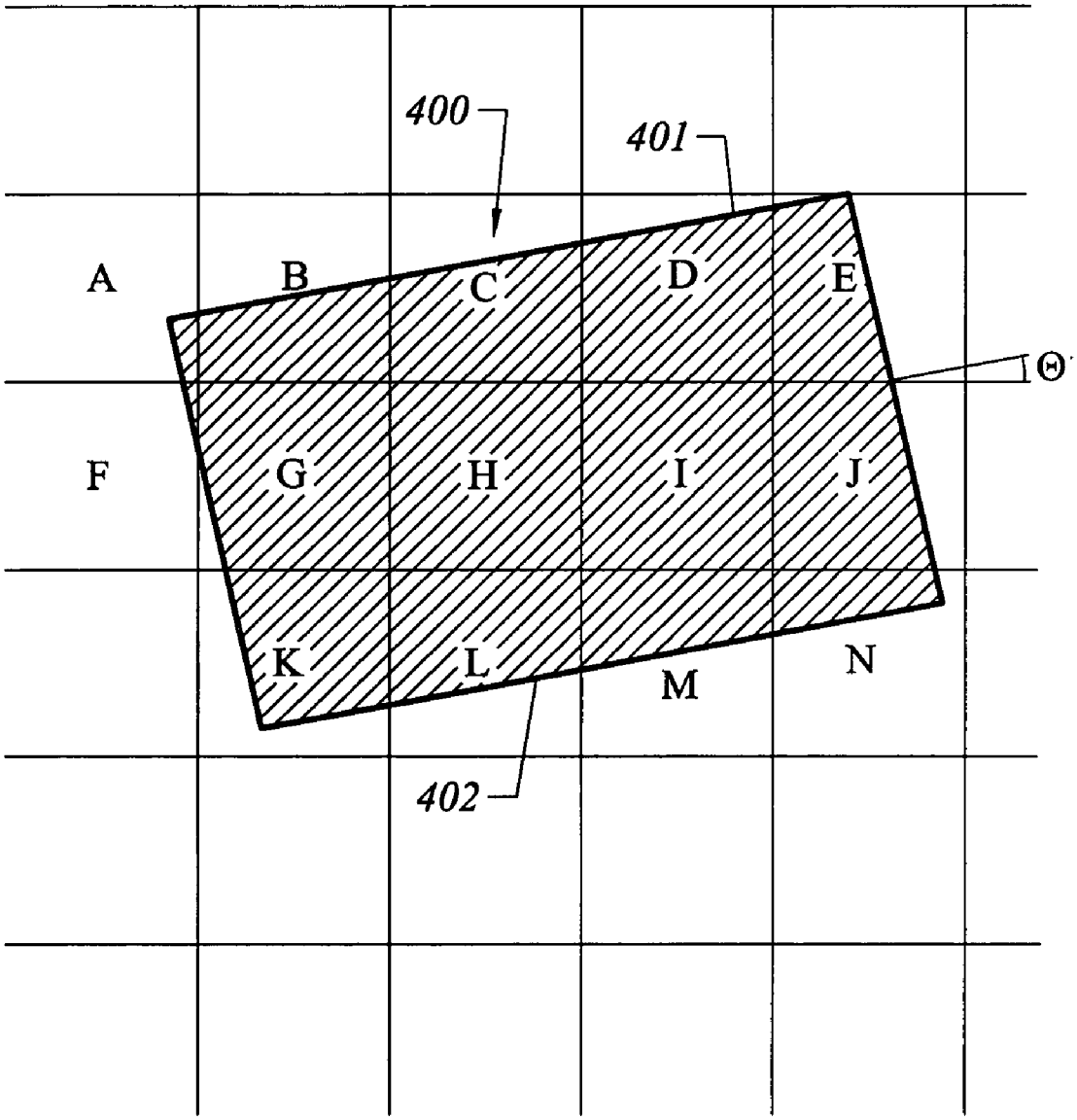
FIG. 4 is a diagram illustrating pixel coverage of a rectangle oriented at an angle within a pixel grid.

FIG. 4 illustrates a rasterized line segment 400 oriented at an angle, θ, with respect to the pixel grid. Pixels G, H, and I are completely covered. Pixels A, B, C, D, E, F, J, K, L, M, and N are partially covered pixels. Note that the pixel coverage values of subsequent edge pixels along an edge may have different values. For example, pixels A, B, C, D and E along edge 401 have different coverage values. Similarly, pixels K, L, M, and N along edge 402 each have different pixel coverage values.

Figure 5:
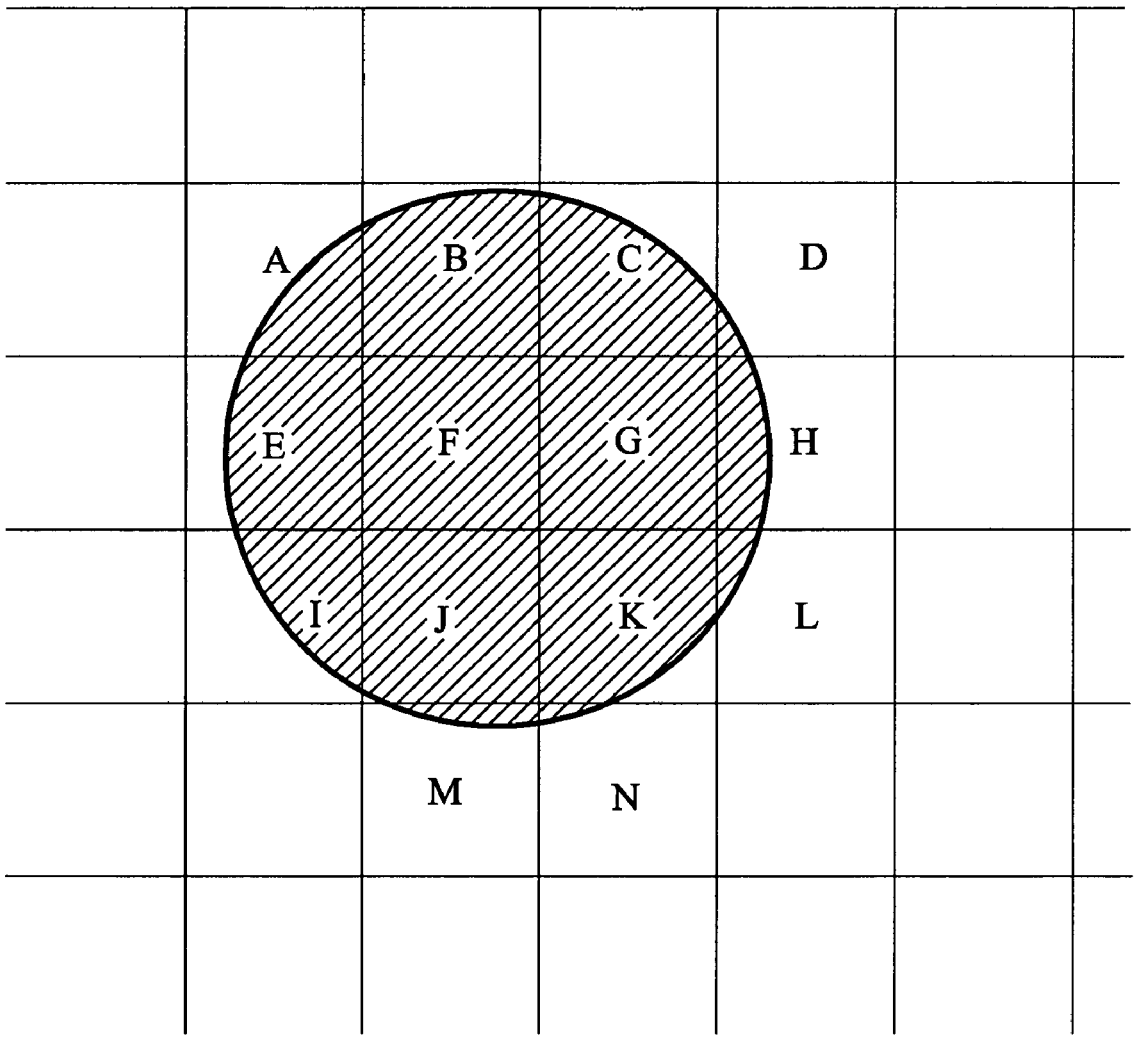
FIG. 5 is a diagram illustrating pixel coverage of a point within a pixel grid.

FIG. 5 illustrates a rasterized point (e.g., a circle) with fragments superimposed over a pixel grid. Pixels F and G are fully covered. The width of the point is represented by its diameter. Pixels A, B, C, D, H, L, K, N, N, M, I, J and E are partially covered pixels. Note that neighboring pixels along the circumference, such as pixels L and K, may have large variations in pixel coverage value.

Figure 6:
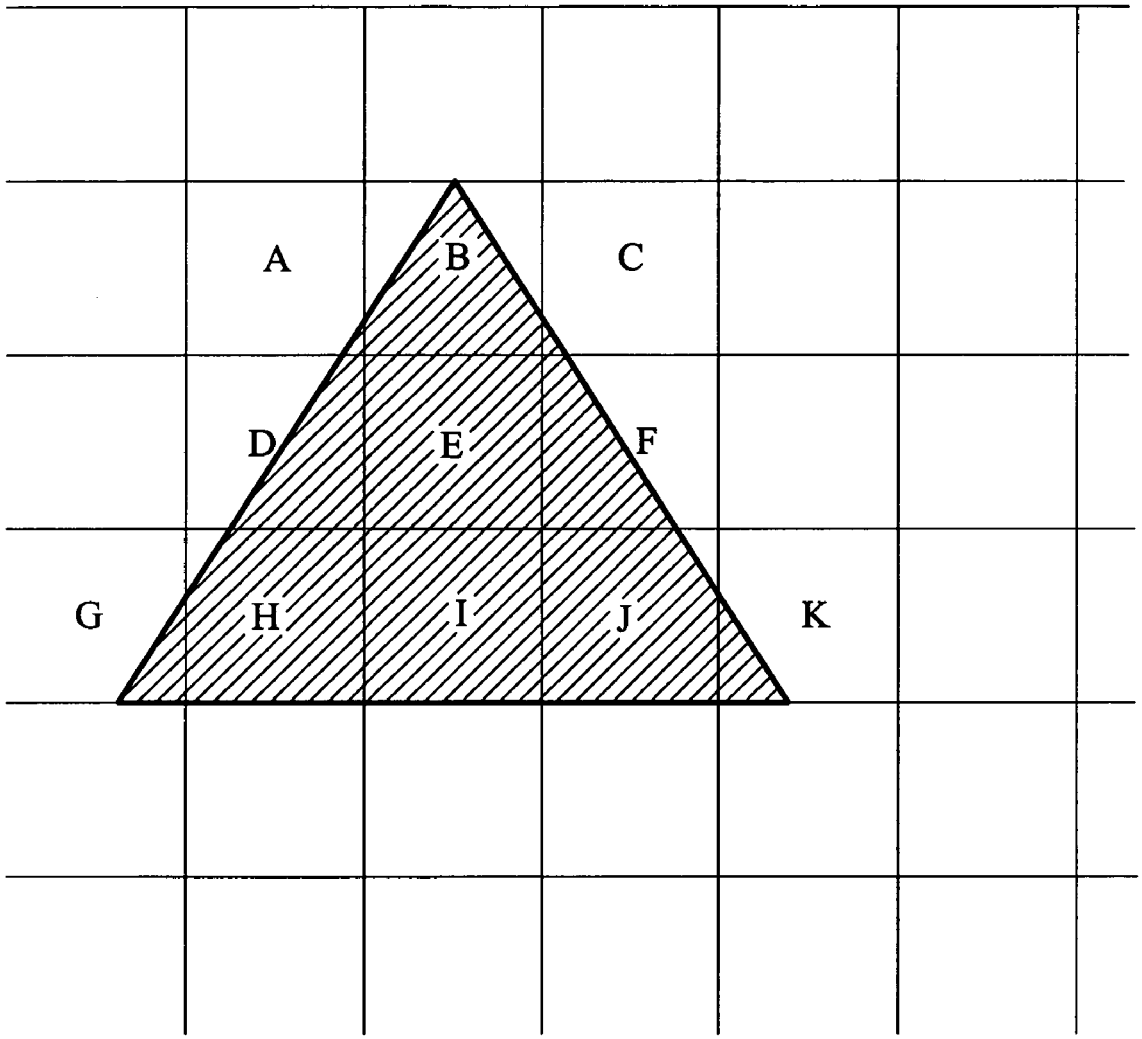
FIG. 6 is a diagram illustrating pixel coverage of a polygon within a pixel grid.

FIG. 6 illustrates a rasterized polygon with respect to a pixel grid. Pixels E and I are completely covered. Pixels A, B, C, D, F, G, H, J, and K are partially covered. Note that neighboring edge pixels along the periphery of the polygon may have different coverage values.

The coverage value of the pixels may be used to determine its brightness and/or its weight in an anti-aliasing process. However, since the coverage value of adjacent pixels along a linear edge will vary linearly (e.g., pixels B, C, and D of FIG. 4), use of the actual coverage values to determine brightness of edge pixels may result in roping artifacts that are exacerbated by the non-linearity of display 160. Moreover, by comparing FIG. 3 and FIG. 4, it can be seen that even a comparatively small translation and/or rotation of a primitive with respect to the pixel grid can cause substantial variations in pixel coverage values along an edge of a primitive.

In the present invention, the coverage value of each pixel of a smoothed primitive is gamma corrected by the graphics processor. The gamma correction is selected to at least partially compensate for the non-linearity of a display.

In one embodiment, the coverage value is raised by an exponent, x, where x is the inverse of the gamma coefficient of the display, with x being the gamma correction factor. The gamma corrected coverage value of a pixel is thus given by the following equation:

$$C_{GammaCorrected}=C^{1/\gamma} \qquad \text{EQ: 1}$$

where C is the coverage value corresponding to the overlap of a fragment with a pixel, γ is the gamma factor of the display, 1/γ is the gamma correction factor, and $C_{GammaCorrected}$ is the gamma corrected coverage value.

In one embodiment, pixels having a coverage value below $C_0$, a preselected threshold coverage value, are assigned a value of zero, resulting in the pixel being discarded in subsequent processing. For this case, the gamma correction formulas are:

$$C_{GammaCorrected}=0 \text{ for } C\leqq C_0 \qquad \text{EQ: 2}$$

$$C_{GammaCorrected}=C^{1/\gamma} \text{ for } C>C_0 \qquad \text{EQ: 3}$$

Referring to equations 1, 2, and 3, for completely covered pixels, the coverage value is one and $C_{GammaCorrected}$ also equals one (i.e., $1^{1/\gamma}=1$). However, since gamma is typically greater than one for common display types (e.g., γ=2.2 for a CRT), the gamma corrected coverage value of partially covered pixels is significantly increased, on a percentage basis, compared to the uncorrected value.

Referring again to FIG. 2, in one embodiment, an anti-aliasing (AA) lookup table 250 is used to gamma correct the coverage values using a gamma correction factor stored in lookup table 250. The correction factor may be combined with the AA lookup table or used as a second table correcting values exiting lookup table 250. Lookup table 250 may be stored as a single table or as sub-tables for each color. Lookup table 250 is stored in a memory of graphics processor 230 to permit the graphics hardware of graphics processor 230 to perform the gamma correction of partially covered pixels. The gamma correction algorithm may be performed in any portion of graphics processor 230 associated with administering the lookup table.

Figure 7:
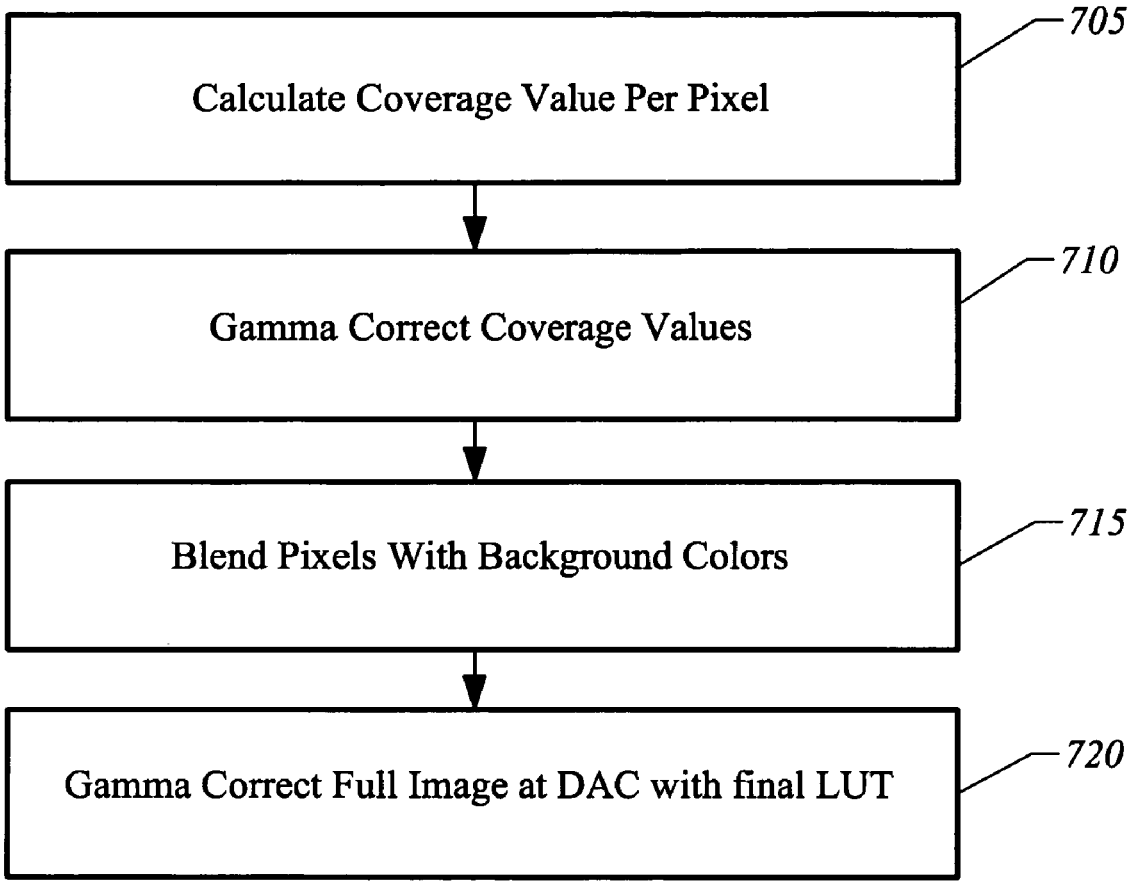
FIG. 7 is a flowchart of a method of gamma correction in accordance with one embodiment of the present invention.

FIG. 7 is a flow chart of one embodiment of a method of gamma correction of partially covered pixels. The coverage value of pixels is calculated 705. The coverage values are gamma corrected 710 in the graphics processor. The gamma corrected coverage values may then be utilized for blending the fragment color with previous fragment colors 715 in place of uncorrected coverage values. Note that the entire image may be gamma corrected 720 at DAC 150 with the final LUT 155.

In one embodiment the gamma corrected coverage values are stored in the lookup table for later use in anti-aliasing. In some embodiments of the present invention the lookup table is a run time loadable lookup table that is dynamically configurable by a user. Referring again to FIG. 2, in one embodiment the correction factors stored in lookup table 250 are written by a lookup table definition module 222 residing within system memory 120.

In one embodiment, lookup definition module 222 is stored as computer executable instructions on system memory 120. Lookup table definition module 222 writes gamma correction factor data into lookup table 250. This permits, for example, the gamma correction factor to be adjusted by a user in response to changing lighting conditions or adjusted for different graphics applications. Additionally, the gamma correction of smoothed primitives may be selectively enabled or disabled (e.g., by turning on or turning off gamma correction of coverage values). Moreover, in some embodiments gamma correction may be enabled/disabled for selected classes of smoothed primitives. For example, gamma correction may be independently enabled/disabled for lines, or for points, for polygons, or for entire scenes. The information describing classes of primitives for which gamma correction is enabled may also be written into the lookup table by lookup table definition module 222. The gamma correction may be performed when a smoothed primitive is drawn, at the time of display, or for an entire scene.

A graphical user interface is preferably provided to make it convenient for a user to select gamma correction parameters (e.g., the gamma correction factor, and enablement of gamma correction for classes of smoothed primitives). In one embodiment, lookup table definition module 222 includes gamma correction user interface module 224. Gamma correction user interface module 224 preferably includes computer executable instructions for generating a graphical user interface having a control panel for a user to input a request for graphics processor 230 to enable gamma correction of one or more classes of smoothed primitives. In one embodiment, gamma correction user interface module 224 permits a user to enter a display type and then calculates the gamma and gamma correction factor for the display type. Alternatively, in another embodiment a user may select the gamma for their display and interface module 224 calculates the gamma correction factor. For CRT displays, gamma, $\gamma$, is about 2.2 whereas for flat panel displays gamma may be in the range of 1.3 to 1.9. In one embodiment the gamma correction values loaded in lookup table 250 are run time loadable. Thus, this permits the gamma correction performed by graphics processor 230 to be enabled, disabled, or adjusted by a user for a specific application.

Figure 8:
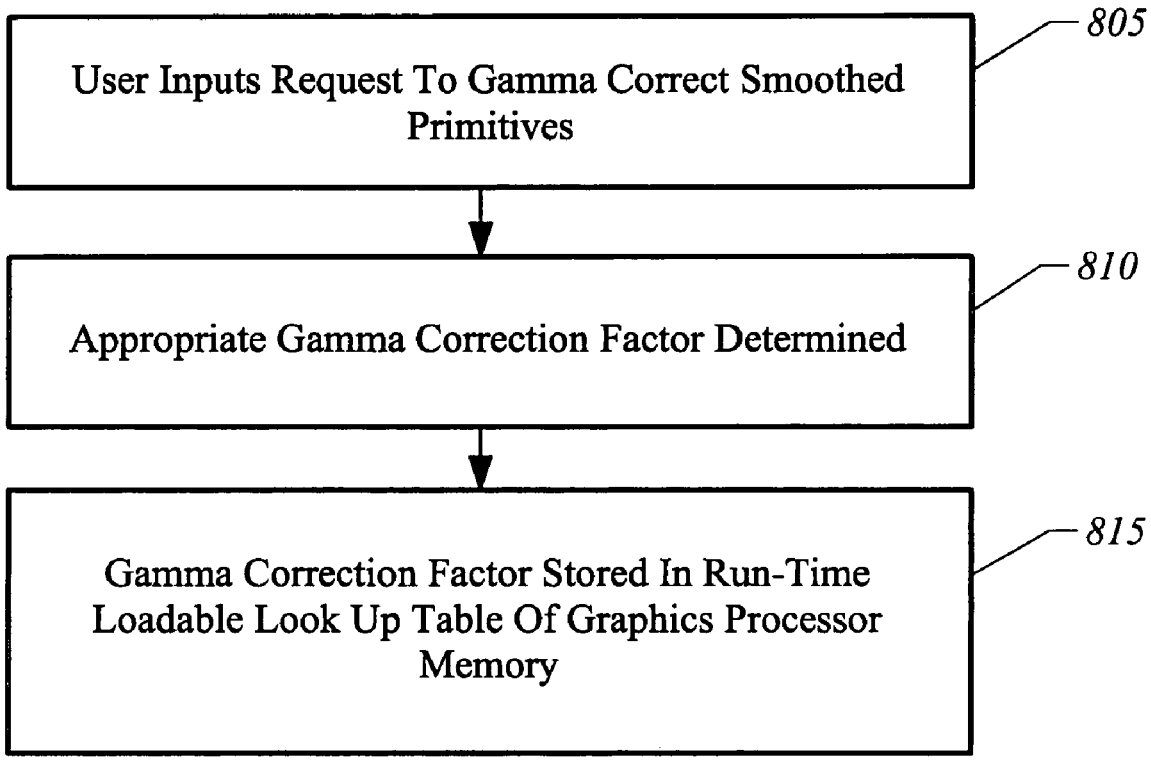
FIG. 8 is a flow chart of a method of inputting gamma correction factors in accordance one embodiment of the present invention.

FIG. 8 is a flowchart illustrating an exemplary sequence of steps for storing gamma correction values as a run time loadable table. A user requests 805 gamma correction of smoothed primitives. Appropriate gamma correction factors are determined 810. A gamma correction factor appropriate for the display is then stored 815 in a memory of the graphics processor.

As previously discussed, the gamma corrected coverage values may be used in a subsequent anti-aliasing process. In one embodiment, blending processor 260 uses the gamma corrected coverage values for individual pixels to determine weights used to blend partially-covered pixels with background pixels stored in the frame buffer during an anti-aliasing process. Such a blending process allows the representation of partially covered pixels and permits the apparent position of edges of lines (and dots and polygons) to be controlled to subpixel precision.

An exemplary set of blending equations to represent the apparent position of edges to sub-pixel precision is illustrated in equations 4, 5, and 6. In these equations, a destination value (Dst) of color brightness for each pixel of a line color is expressed in terms of an initial brightness of a linecolor, the brightness value of a corresponding background pixel stored in the framebuffer, and a coverage value C:

$$\text{Dst-red}=\text{linecolor}_{red}C+\text{Background}_{red}(1-C) \quad \text{EQ. 4}$$

$$\text{Dst-green}=\text{linecolor}_{green}C+\text{Background}_{green}(1-C) \quad \text{EQ. 5}$$

$$\text{Dst-blue}=\text{linecolor}_{blue}C+\text{Background}_{blue}(1-C) \quad \text{EQ. 6}$$

Equations 4, 5, and 6 are for the case that gamma correction is not enabled. When gamma correction of smoothed primitives is enabled, the coverage values of Equations 4, 5, and 6 are adjusted to use the gamma corrected coverage value, as illustrated in Equations, 7, 8, and 9 in which the gamma corrected coverage value is substituted for the coverage value:

$$\text{Dst-red}=\text{linecolor}_{red}C_{GammaCorrected}+\text{Background}_{red}(1-C_{GammaCorrected}) \quad \text{EQ. 7}$$

$$\text{Dst-green}=\text{linecolor}_{green}C_{GammaCorrected}+\text{Background}_{green}(1-C_{GammCorrected}) \quad \text{EQ. 8}$$

$$\text{Dst-blue}=\text{linecolor}_{blue}C_{GammaCorrected}+\text{Background}_{blue}(1-C_{GammaCorrected}) \quad \text{EQ. 9}$$

Equations 7, 8, and 9 can be re-expressed as:

$$\text{Dst-red}=\text{linecolor}_{red}C^{1/\gamma}+\text{Background}_{red}(1-C^{1/\gamma}) \quad \text{EQ. 10}$$

$$\text{Dst-green}=\text{linecolor}_{green}C^{1/\gamma}+\text{Background}_{green}(1-C^{1/\gamma}) \quad \text{EQ. 11}$$

$$\text{Dst-blue}=\text{linecolor}_{blue}C^{1/\gamma}+\text{Background}_{blue}(1-C^{1/\gamma}) \quad \text{EQ. 12}$$

From equations 10–12, it can be understood that when gamma correction is enabled, the effective coverage values of partially covered pixels changes, which adjusts the weight to which the background is blended during anti-aliasing. In particular, for a gamma greater than one, the gamma corrected coverage factor increases, resulting in a reduction in the weight with which the background is blended into partially covered pixels.

In one embodiment, lookup table definition module 222 and gamma correction user interface module 224 are embodied in a software driver module. Consequently, it will be understood that an embodiment of the present invention relates to a computer storage product with a computer-readable medium having computer code thereon for performing various computer-implemented operations. The media and computer code may be those specially designed and constructed for the purposes of the present invention, or they may be of the kind well known and available to those having skill in the computer software arts. Examples of computer-readable media include, but are not limited to: magnetic media such as hard disks, floppy disks, and magnetic tape; optical media such as CD-ROMs and holographic devices; magneto-optical media such as optical disks; and hardware devices that are specially configured to store and execute program code, such as application-specific integrated circuits ("ASICs"), programmable logic devices ("PLDs") and ROM and RAM devices. Examples of computer code include machine code, such as produced by a compiler, and files containing higher-level code that are executed by a computer using an interpreter. For example, an embodiment of the invention may be implemented using Java, C++, or other object-oriented programming language and development tools. Another embodiment of the invention may be implemented in hardwired circuitry in place of, or in combination with, machine-executable software instructions.

Referring again to FIG. 2, the gamma correction of the present invention of smoothed primitives may be used in conjunction with conventional gamma correction of an entire display screen. System 200 may include a conventional gamma correction capability using LUT 155 and DAC 150. However, the gamma correction of LUT 155 may be incorrect or not set by a user, or dictated by the operating system or other applications. Moreover, as previously discussed, conventional gamma correction does not necessarily address roping artifacts associated with antialiasing the edges of primitives to sub-pixel precision. Thus, the gamma correction of the present invention provides a different type of gamma correction which is beneficial to a user to optimize the appearance of lines and edges without affecting other aspects of the image.

While the present has been described in regards to several different smoothed primitives, it will be understood that the present invention is applicable to a variety of vector graphics primitives.

The foregoing description, for purposes of explanation, used specific nomenclature to provide a thorough understanding of the invention. However, it will be apparent to one skilled in the art that specific details are not required in order to practice the invention. Thus, the foregoing descriptions of specific embodiments of the invention are presented for purposes of illustration and description. They are not intended to be exhaustive or to limit the invention to the precise forms disclosed; obviously, many modifications and variations are possible in view of the above teachings. The embodiments were chosen and described in order to best explain the principles of the invention and its practical applications, they thereby enable others skilled in the art to best utilize the invention and various embodiments with various modifications as are suited to the particular use contemplated. It is intended that the following claims and their equivalents define the scope of the invention.

What is claimed is:

1. A method of using a graphics processor to reduce visual artifacts, comprising:

receiving an instruction for selectively enabling gamma correction of a selected class of primitive types, said selected class including at least one member selected from a group of at least two different primitive types;

rasterizing primitives of a graphical image to generate fragments;

for each pixel partially covered by a primitive of a primitive type belonging to said selected class of primitive types, gamma correcting its coverage value to form at least one gamma corrected coverage value; and for each pixel partially covered by a primitive of a primitive type not belonging to said selected class of primitive types, not gamma correcting its coverage value.

2. The method of claim 1, wherein said group of at least two different primitive types consists of a line, a stippled line, a circle, and a polygon.

3. The method of claim 1, further comprising: providing a user interface for a user to input a command for selecting members of said selected class.

4. The method of claim 3, further comprising:

receiving a command from said user interface specifying a display type; and determining a gamma correction factor appropriate for said display type.

5. The method of claim 1, further comprising: providing a user interface for a user to disable gamma correction of all members of said group.

6. The method of claim 1, further comprising: providing a user interface for a user to enable gamma correction of all members of said group.

7. The method of claim 1, wherein said instruction enables gamma correction of one or more types of primitives for a particular scene.

8. A method of forming smoothed primitives in a graphics system having a CPU and a graphics processor, comprising:

receiving a request from a user to selectively enable gamma correction of a selected class of primitive types, said selected class including at least one member selected from a group of at least two different primitive types;

determining a gamma correction factor for said selected class of primitive types;

in said graphics processor, determining a coverage value per pixel for each fragment of a primitive;

in said graphics processor, gamma correcting coverage values of fragments generated for primitives having a primitive type belonging to said selected class of primitives, said gamma correction factor being selected to account for a non-linear response of a display, said graphics processor not performing gamma correction of coverage values for primitives having a primitive type not belonging to said selected class of primitive types; and in said graphics processor, performing an anti-aliasing process using said gamma corrected coverage values in place of corresponding coverage values.

9. The method of claim 8, wherein said group of at least two different primitive types consists of a line, a stippled line, a circle, and a polygon.

10. The method of claim 8 wherein:

said performing includes blending partially covered pixels with background pixels, with a weight assigned to partially covered pixels being given by the gamma corrected coverage value and a weight assigned to background pixels being one minus the gamma corrected coverage value.

11. The method of claim 8, wherein said anti-aliasing process generates an anti-aliased image, the method further comprising: in a display, gamma correcting each pixel of said antialiased image.

12. A graphics system, comprising:

a graphics processor, including:

a geometry processor to generate geometric primitives;

a rasterizer to convert geometric primitives into fragments;

a coverage completion module to calculate a coverage value per pixel of a primitive;

a look up table to store a gamma correction factor for gamma correction of a selected class of primitive types, said selected class including at least one member selected from a group of at least two different primitive types; and said graphics processor performing gamma correction of coverage values of primitives having a primitive type belonging to said selected class of primitive types said graphics processor not performing gamma correction of coverage values for primitives having a primitive type not belonging to said selected class of primitive types.

13. The method of claim 12, wherein said group of at least two different primitive types consists of a line, a stippled line, a circle, and a polygon.

14. The graphics system of claim 12, wherein said gamma correction factor is written into said lookup table in response to a user request.

15. The graphics system of claim 12, further comprising:

a blending processor adapted to blend partially covered pixels with background pixels to achieve sub-pixel resolution of edges of primitives, wherein said blending processor uses said gamma corrected coverage values for coverage values used to anti-alias said primitive.

16. The graphics system of claim 12, wherein said graphics processor is configured to receive said gamma correction factor in response to a user input entered from a graphical user interface.

17. The graphics system of claim 12, further comprising:

a central processing unit having an associated system memory, said central processing unit and said associated system memory coupled to said graphics processor by a bus.

18. The graphics system of claim 17, further comprising:

a user interface for a user input commands to selectively enable gamma correction of two or more different types of primitives.

19. The graphics system of claim 17, further comprising:

a user interface for a user to input commands to enable or disable gamma correction of partially covered primitives.

20. The graphics system of claim 12, wherein said lookup table is run time loadable.

* * * * *